US007134168B1

(12) United States Patent
Qing

(10) Patent No.: US 7,134,168 B1
(45) Date of Patent: Nov. 14, 2006

(54) DOOR CLOSER WITH PRE-SET STOPS

(75) Inventor: Wu Feng Qing, Chong Xing Town (CN)

(73) Assignee: Betteli, Inc. Hong Kong, Hong Kong (HK)

( * ) Notice: Subject to any disclaimer, the term of this patent is extended or adjusted under 35 U.S.C. 154(b) by 105 days.

(21) Appl. No.: 10/920,754

(22) Filed: Aug. 18, 2004

(51) Int. Cl.
*E05F 3/02* (2006.01)
*E05F 1/08* (2006.01)

(52) U.S. Cl. ..... 16/80; 16/66

(58) Field of Classification Search ..... 16/66, 16/71, 72, 82, 84, 85, 49, DIG. 10; 292/DIG. 4, 292/306, 262, 278
See application file for complete search history.

(56) References Cited

U.S. PATENT DOCUMENTS

| | | | | | |
|---|---|---|---|---|---|
| 3,090,988 | A * | 5/1963 | Truhon | | 16/66 |
| 3,105,264 | A * | 10/1963 | Truhon | | 16/66 |
| 3,162,889 | A * | 12/1964 | Runnels | | 16/66 |
| 4,382,311 | A * | 5/1983 | Watts | | 16/66 |
| 4,483,044 | A * | 11/1984 | Johnston et al. | | 16/70 |
| 4,639,969 | A | 2/1987 | Obenshain | | |
| 4,722,116 | A * | 2/1988 | Erickson | | 16/49 |
| 4,815,163 | A * | 3/1989 | Simmons | | 16/49 |
| 5,529,148 | A * | 6/1996 | O'Leary | | 188/67 |
| 5,592,780 | A * | 1/1997 | Checkovich | | 49/386 |
| 5,630,248 | A | 5/1997 | Luca | | |
| 5,832,562 | A | 11/1998 | Luca | | |
| 5,842,255 | A | 12/1998 | Luca | | |
| 6,615,449 | B1 * | 9/2003 | Alvarez | | 16/66 |
| 6,634,058 | B1 * | 10/2003 | Lin | | 16/66 |
| 2003/0126716 | A1 * | 7/2003 | Lin | | 16/66 |
| 2003/0226235 | A1 * | 12/2003 | Hodson | | 16/66 |

FOREIGN PATENT DOCUMENTS

| | | | |
|---|---|---|---|
| JP | 11082589 | A1 * | 3/1999 |
| WO | WO 8805852 | A1 * | 8/1988 |
| WO | WO 9642077 | A1 * | 12/1996 |

* cited by examiner

*Primary Examiner*—Chuck Y. Mah
(74) *Attorney, Agent, or Firm*—McKee, Voorhees & Sease, P.L.C.

(57) ABSTRACT

A door closer comprises a cylinder with an extensible and retractable rod. The cylinder has a first end adapted to be secured to a door frame, while the rod has an outer end adapted to be connected to the door. The rod has a series of grooves along the length. A pawl is mounted in a housing on one end of the cylinder and is adapted for movement between an engaged position engaging one of the grooves of the rod and a disengaged position. A button on the housing is adapted to be depressed to move the pawl to the engaged position, whereby the pawl holds the door open in a selected position. The pawl can be disengaged from the rod merely by opening the door slightly, after which the spring-biased rod automatically pulls the door to the closed position.

14 Claims, 3 Drawing Sheets

DOOR CLOSER WITH PRE-SET STOPS

BACKGROUND OF THE INVENTION

Door closers having a cylinder with a spring biased arm or rod have been known for many years for use on screen doors and storm doors. The closer normally biases the door to a closed position so that the door will automatically shut after being opened. Various mechanisms have been provided on door closers so as to hold the door in an open position.

One example of a door closer with a mechanism for holding the door open is disclosed in U.S. Pat. No. 5,832,562. This closer uses a cylinder with a spring biased rod extending through a washer in the cylinder. A button on the cylinder moves the washer to a canted position relative to the rod so as to frictionally retain the rod in an extended position so as to hold the door open. This structure relies solely upon the friction between canted washer and the rod to hold the door open. Thus, wind forces on the outside of the door may overcome the friction so as to wholly or partially close the door.

Another example of a closer with a mechanism to retain the door in an open position is disclosed in U.S. Pat. No. 4,639,969, which utilizes a plurality of notches in the rod and a pawl which engages one of the notches to maintain the door in an open position. A problem with this mechanism is that the pawl must be manually lifted from engagement with the rod so as to allow the door to close.

Therefore, a primary objective of the present invention is the provision of an improved door closer with a mechanism to retain the door in an open position.

Another objective of the present invention is the provision of a door closer having a mechanical lock to hold the door in a selected one of multiple open positions.

A further objective of the present invention is the provision of a door closer having a button-actuated mechanism to retain the door in an opened position.

Another objective of the present invention is the provision of a door closer having a mechanism to hold the door in an open position which can be de-actuated quickly and easily.

Yet another objective of the present invention is the provision of an improved door closer having a mechanism to retain the door in an open position, with the mechanism being released simply by opening the door slightly further, so that the door will close.

A further objective of the present invention is the provision of an improved door closer having a mechanism to retain the door in a selected open position and which is economical to manufacture and durable and safe in use.

These and other objectives will become apparent from the following description of the invention.

SUMMARY OF THE INVENTION

The door closer of the present invention includes a cylinder having a spring biased extensible and retractable rod. The cylinder is connected to the door frame and the rod is connected to the door. The rod has a series of grooves. A pawl is mounted on the cylinder adjacent the rod for movement between an engaged or locked position and a disengaged or unlocked position. In the engaged position, the pawl engages one of the grooves in the rod so as to maintain the door in an open position. When the pawl is in the disengaged position, the rod is free to retract into the cylinder so as to close the door. The pawl is actuated into the engaged position by a button. The pawl is disengaged from the rod simply by opening the door slightly.

In order to hold the door in a desired or selected open position, the door is opened to a position beyond the selected position. The button is then depressed so as to engage the pawl with the piston rod. The door is then partially closed so that the pawl engages the adjacent groove in the piston rod so as to hold the door open in the selected position. To release the door for closing, the door is opened slightly so that the pawl is disengaged from the rod. The spring biasing of the rod pulls the door closed.

DETAILED DESCRIPTION OF THE PREFERRED EMBODIMENT

Figure 1:
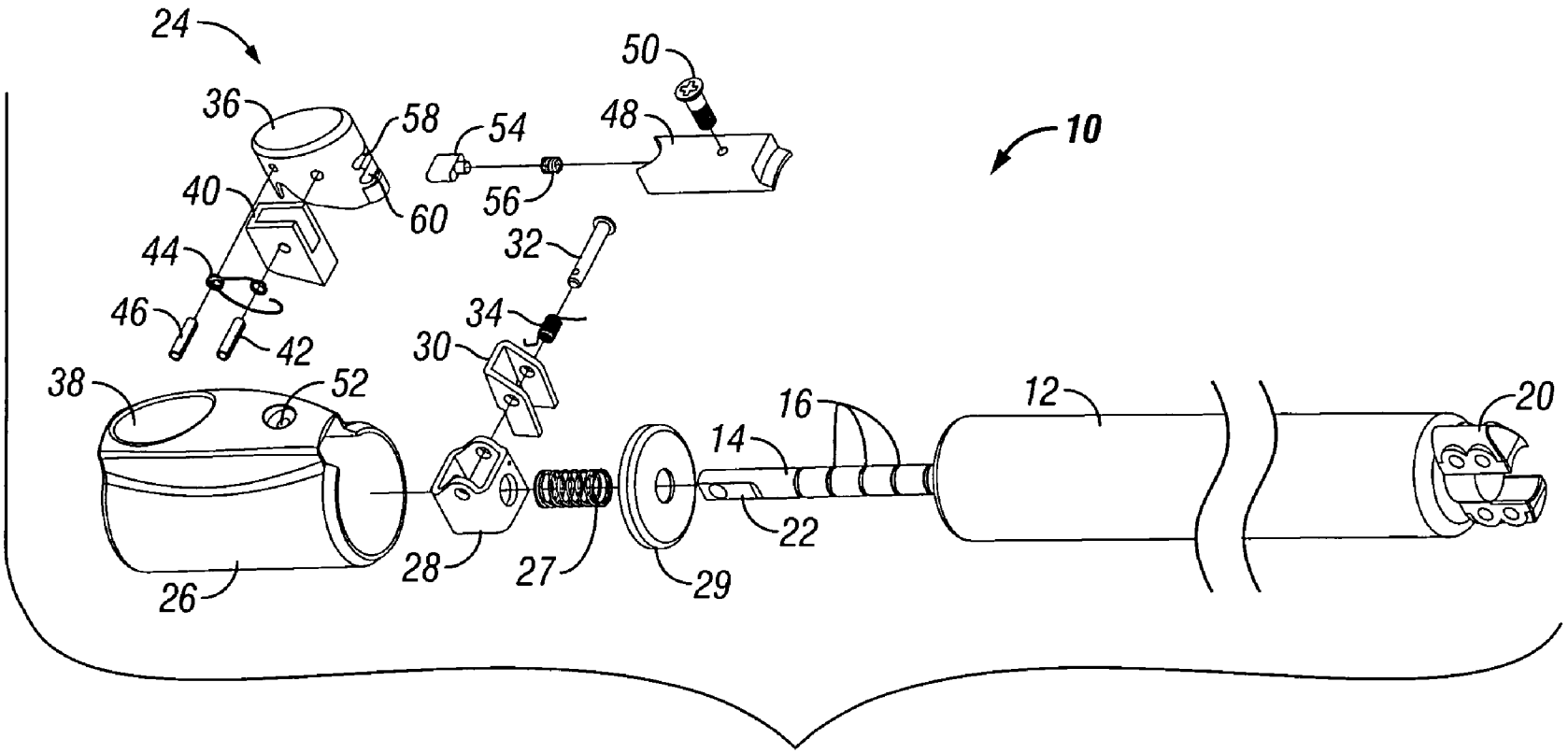
FIG. 1 is an exploded view of the components of the piston rod assembly and mechanism for holding the door in a selected open position, according to the present invention.

In FIG. 1 a piston-cylinder assembly is generally designated by the reference numeral 10. The assembly 10 includes a cylinder 12 with an extensible and retractable rod 14. The rod 14 includes a series of grooves or notches 16 extending along its length. A spring (not shown) within the cylinder 12 normally biases the rod 14 to a retracted position. The first end 20 of the assembly is adapted to be connected to a door frame (not shown), while the second end 22 of the assembly, which is the outer end of the rod 14, is adapted to be connected to the door (not shown).

The piston-cylinder assembly 10 is provided with a mechanism 24 to hold the door in a selected open position. More particularly, the mechanism includes a housing 26 mounted on the cylinder 12 opposite the first end 20 of the assembly 10. A collar or pawl block 28 is slidably mounted on the rod 14, and is biased by a spring 27 sandwiched between the collar 28 and a washer 29 mounted on the rod 14. A pawl 30 is pivotally mounted within the collar 28 by a pin 32. A spring 34 normally biases the pawl 30 to a disengaged or unlocked position, as described below.

A button 36 extends upwardly through a hole 38 in the housing 26. A cam 40 is pinned inside the button 36 by a cam pin 42. A spring 44 is mounted inside the cam 40 and is connected to the button 36 by the cam pin 42 and a spring pin 46. The spring 44 normally biases the button 36 to a raised position.

A block 48 extends into the end of the housing 26 and is secured thereto by a screw 50 extending downwardly through an upper hole 52 in the housing 26. The block 48 houses a detent 54 which is biased outwardly by a spring 56. The detent is adapted to engage one of the notches 58, 60 in the sidewall of the button 36.

Figure 2:
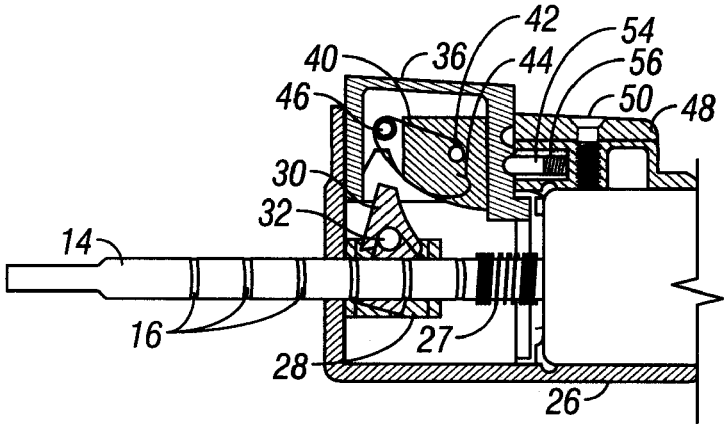
FIG. 2 is a partial sectional side view showing the rod in a fully retracted position when the door is closed.

The operation of the piston-cylinder assembly 10 is shown in FIGS. 2–6. In FIG. 2, the door is closed, with the rod 14 being fully retracted into the cylinder 12. The button 36 is in the raised position, with the detent 54 engaging the lower notch 50 of the button 36. The pawl 30 is disengaged from the rod 14.

Figure 3:
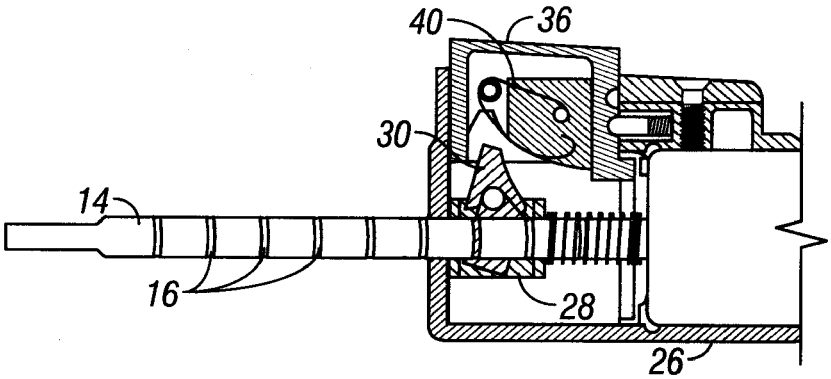
FIG. 3 is a view similar to FIG. 2 showing the rod in an extended position when the door is fully opened.

FIG. 3 shows the assembly 10 with the rod 14 fully extended from the cylinder 12, when the door is fully opened. The button 36 is up, and the pawl 30 is disengaged from the rod 14.

Figure 4:
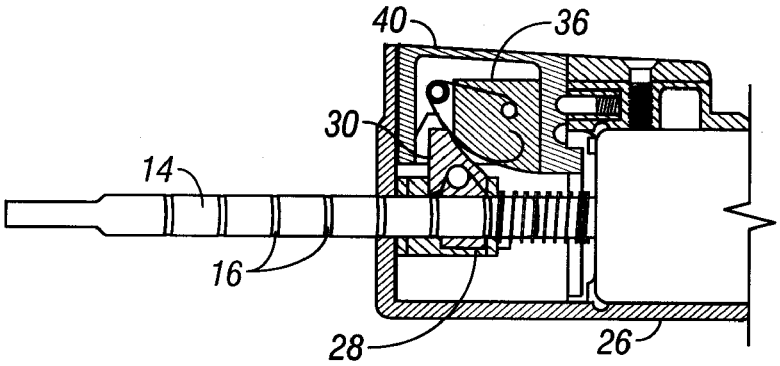
FIG. 4 is a view similar to FIG. 3 showing the button depressed so as to prepare the mechanism to hold the door in an open position.

If a person wants to hold the door in a selected open position, the person depresses the button 36 as shown in FIG. 4. The detent 54 engages the upper notch 58 on the button 36 to hold the button down, against the bias of spring 44. When the button 36 is depressed, the cam 40 engages the pawl 30 which pivots about pin 32 into engagement with the rod 14 against the bias of the spring 34.

Figure 5:
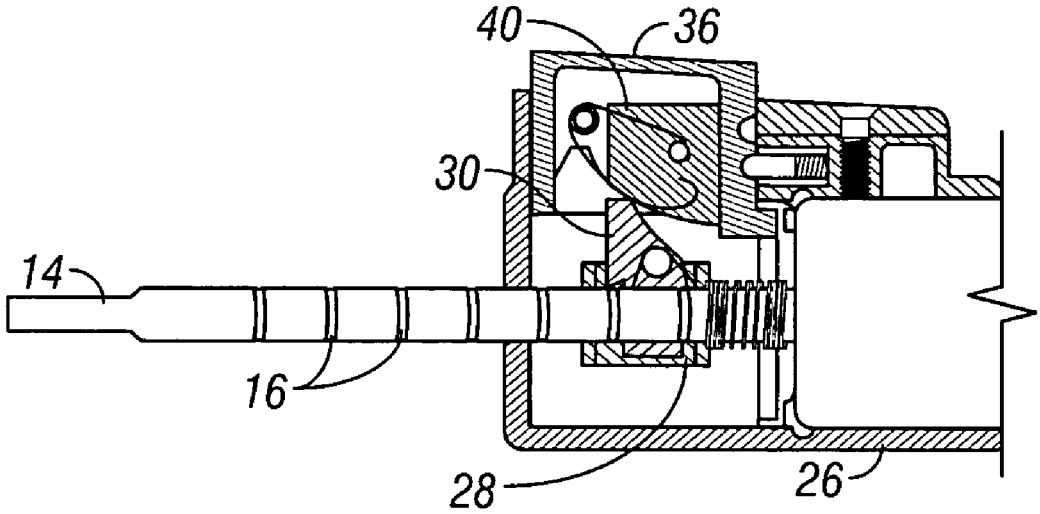
FIG. 5 is a view similar to FIG. 4 showing the pawl engaged in one of the grooves in the rod so as to maintain the door in a selected open position.

The door is then pulled or pushed inward or closed slightly so that the pawl 30 engages the next adjacent groove 16 in the rod 14 and thereby hold the door in the selected open position, as seen in FIG. 5. The rod spring 27 is compressed. The button 36 returns to the raised position due to the bias of spring 44. Alternatively, the door may be opened slightly while the button 36 is depressed so that the pawl 30 engages the next adjacent groove 16 in the rod.

Figure 6:
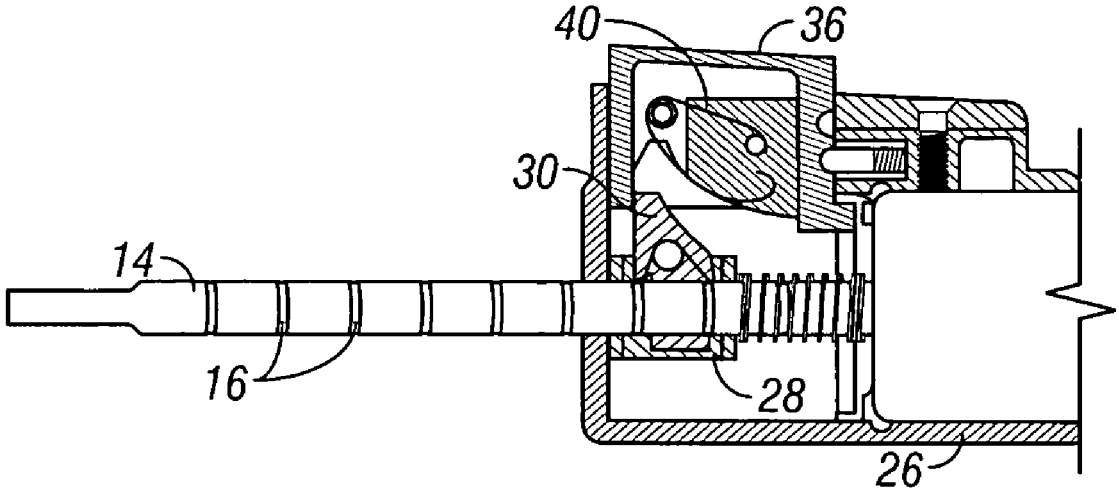
FIG. 6 is a view similar to FIG. 5 showing the door slightly opened in preparation for releasing the pawl from the rod groove so that the door can be closed.

When a person desires to release the door from the locked open position, the door is simply opened slightly so as to extend the rod 14, which causes the spring 27 to force the collar or pawl block 28 to the left, as seen in FIG. 6. This movement of the collar 28 allows the spring 34 to pivot the pawl 30 out of engagement with the selected groove or notch 16 of the rod 14, whereby the rod 14 can retract into the cylinder 12 and pull the door closed, with the components of the assembly 10 returning to the positions shown in FIG. 2.

Thus, with the piston-cylinder assembly 10 and mechanism 24 of the present invention, a person can hold the door at any one of numerous open positions corresponding to the grooves 16 in the rod 14. The further the rod 14 is extended before depressing the button 36, the greater degree the door will be held open. Once the button 36 is depressed and door is moved slightly toward the closed position, the pawl 30 will engage the next adjacent groove 16 in the rod 14 so as to maintain the door in the selected open position. The door can be easily closed merely by moving the door slightly toward the open position, whereby the pawl 30 disengages from the rod 14 such that the spring biased rod 14 automatically pulls the door to the closed position.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A door closer comprising:

a cylinder with an extensible and retractable rod, the cylinder having first and second ends with the first end adapted to be secured to a door frame and the rod having an outer end adapted to be connected to the door, the rod being normally biased to a retracted position;

the rod having a series of grooves;

a housing connected to the cylinder;

a pawl block mounted on the rod and in the housing;

a pawl pivotally mounted on the pawl block for movement between an engaged position engaging one of the grooves and a disengaged position, the pawl being normally biased to the disengaged position;

a button on the housing and adapted to move between a depressed position to engage the pawl and thereby move the pawl to the engaged position and a raised position to disengage the pawl and thereby allow the pawl to move to the disengaged position;

whereby the pawl holds the door open when in the engaged position and allows the door to open and close when in the disengaged position; and the button being non-electrical.

2. The door closer of claim 1 further comprising a spring to normally urge the pawl to the disengaged position.

3. The door closer of claim 1 further comprising a spring to normally urge the button to the raised position.

4. The door closer of claim 1 wherein the pawl is mounted outside the cylinder.

5. A method of holding a door in a selected open position relative to a door frame using a piston-cylinder assembly having a biased rod connected to the door and a cylinder connected to the frame, the method comprising:

opening the door to a position beyond the selected position;

pushing a button on the piston-cylinder assembly so as to engage and pivot a pawl pivotally mounted on a pawl block enclosed within a housing and slidably mounted on the rod such that the pawl engages the rod;

the button normally being in a raised position disengaged from the pawl such that the pawl is normally disengaged from the rod;

moving the door toward a closed position so that the pawl engages one of a series of grooves in the rod and thereby hold the door in the selected position; and engaging and disengaging the pawl without an electrical switch.

6. The method of claim 5 further comprising releasing the door from the selected position by opening the door and spring biasing the pawl to a position disengaged from the rod, whereby the door can be closed.

7. The method of claim 5 further comprising biasing the pawl toward a disengaged position.

8. The method of claim 5 further comprising biasing the button toward the raised position.

9. The method of claim 5 further comprising biasing the rod toward a retracted position.

10. An improved mechanical door closer for controlling movement of a door, the closer including a cylinder and a biased rod mounted in the cylinder for movement between extended and retracted positions, the improvement comprising:

a plurality of grooves on the rod;

a pawl block mounted on the rod;

a pawl pivotally mounted on the pawl block to engage one of the grooves in the rod to preclude the rod from retracting;

a spring to bias the pawl out of engagement from the rod so that the rod can retract;

a housing to enclose the pawl and spring; and the pawl being moved to and from engagement without an electrical switch.

11. The improved door closer of claim 10 further comprising a button moveable between a depressed position to move the pawl into engagement with the rod and a raised position to allow the pawl to disengage the rod.

12. The improved door closer of claim 11 wherein the button is biased to the raised position.

13. The improved door closer of claim 10 wherein the pawl is outside the cylinder.

14. The improved door closer of claim 10 wherein the pawl is pivotally movable between engaged and disengaged positions relative to the rod.

* * * * *